US011702888B2

(12) United States Patent
Gregurek et al.

(10) Patent No.: US 11,702,888 B2
(45) Date of Patent: Jul. 18, 2023

(54) WINDOW MILL AND WHIPSTOCK CONNECTOR FOR A RESOURCE EXPLORATION AND RECOVERY SYSTEM

(71) Applicant: Baker Hughes Oilfield Operations LLC, Houston, TX (US)

(72) Inventors: Philip M. Gregurek, Katy, TX (US); Kevin Edgar Harrington, Milano, TX (US); Gregory Hern, Porter, TX (US); Jason Cullum, League City, TX (US); Valerie Ferdin, Spring, TX (US); Gaute Grindhaug, Hafrsfjord (NO); Morten Eidem, Trondheim (NO); Jonathan Cotten, Montgomery, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 76 days.

(21) Appl. No.: 17/356,621

(22) Filed: Jun. 24, 2021

(65) Prior Publication Data

US 2021/0317705 A1 Oct. 14, 2021

Related U.S. Application Data

(63) Continuation-in-part of application No. 16/829,064, filed on Mar. 25, 2020, now Pat. No. 11,162,315.

(51) Int. Cl.
*E21B 29/06* (2006.01)
*E21B 7/06* (2006.01)

(52) U.S. Cl.
CPC ..... *E21B 7/061* (2013.01); *E21B 29/06* (2013.01)

(58) Field of Classification Search
CPC ..... E21B 7/061; E21B 29/06
See application file for complete search history.

(56) References Cited

U.S. PATENT DOCUMENTS

| | | | |
|---|---|---|---|
| 3,115,933 | A | 12/1963 | Haeber |
| 3,223,164 | A | 12/1965 | Otteman |
| 3,409,096 | A | 11/1968 | Brown |
| 4,216,835 | A | 8/1980 | Nelson |
| 5,002,131 | A | 3/1991 | Cromar et al. |
| 5,109,924 | A | 5/1992 | Juergens et al. |

(Continued)

FOREIGN PATENT DOCUMENTS

| | | | |
|---|---|---|---|
| EP | 0916014 | A1 | 5/1999 |
| WO | 02097234 | A1 | 12/2002 |

(Continued)

OTHER PUBLICATIONS

"Timken introduces two high performance alloy steel grades" Offshore Magazine, Offshore Staff, Nov. 11, 2013 (Add Page Numbers).

(Continued)

*Primary Examiner* — Taras P Bemko
(74) *Attorney, Agent, or Firm* — Cantor Colburn LLP

(57) ABSTRACT

A method of performing a well bore operation in a well bore includes connecting a window mill to a whipstock connector forming a tubular section, supporting a tool below the whipstock connector, running the window mill, the whipstock connector, and the tool into the well bore, and axially loading the tool to perform the well bore operation.

15 Claims, 18 Drawing Sheets

(56) References Cited

U.S. PATENT DOCUMENTS

| | | | | |
|---|---|---|---|---|
| 5,431,220 | A | 7/1995 | Lennon et al. | |
| 5,474,126 | A | 12/1995 | Lynde et al. | |
| 5,592,991 | A | 1/1997 | Lembcke et al. | |
| 5,699,858 | A | 12/1997 | McAnally | |
| 5,709,265 | A | 1/1998 | Haugen et al. | |
| 5,718,291 | A | 2/1998 | Lorgen et al. | |
| 5,803,176 | A | 9/1998 | Blizzard, Jr. et al. | |
| 5,878,818 | A | 3/1999 | Hebert et al. | |
| 6,032,740 | A | 3/2000 | Schnitker et al. | |
| 6,311,792 | B1 | 11/2001 | Scott et al. | |
| 6,464,002 | B1 | 10/2002 | Hart et al. | |
| 6,550,540 | B2 | 4/2003 | Trent | |
| 6,695,056 | B2 * | 2/2004 | Haugen | E21B 27/00 166/55.2 |
| 7,178,609 | B2 | 2/2007 | Hart et al. | |
| 7,878,253 | B2 | 2/2011 | Stowe et al. | |
| 8,327,944 | B2 | 12/2012 | King et al. | |
| 8,453,729 | B2 | 6/2013 | Harris et al. | |
| 8,469,096 | B2 | 6/2013 | McGarian | |
| 8,967,279 | B2 | 3/2015 | Hered et al. | |
| 9,140,083 | B2 | 9/2015 | Delgado et al. | |
| 9,267,355 | B2 | 2/2016 | Lumbye | |
| 10,227,823 | B2 | 3/2019 | Hern et al. | |
| 10,563,471 | B2 | 2/2020 | Georgsen et al. | |
| 10,724,319 | B2 * | 7/2020 | Hulsewe | E21B 29/06 |
| 2002/0170713 | A1 | 11/2002 | Haugen et al. | |
| 2004/0007390 | A1 | 1/2004 | Zupanick | |
| 2004/0238171 | A1 | 12/2004 | McGarian et al. | |
| 2005/0039905 | A1 * | 2/2005 | Hart | E21B 10/55 166/55.7 |
| 2006/0207771 | A1 | 9/2006 | Rios et al. | |
| 2007/0044954 | A1 | 3/2007 | Dewey | |
| 2009/0266544 | A1 * | 10/2009 | Redlinger | E21B 29/005 166/298 |
| 2009/0266556 | A1 | 10/2009 | Swenson et al. | |
| 2010/0012322 | A1 * | 1/2010 | McGarian | E21B 7/061 166/298 |
| 2010/0224372 | A1 | 9/2010 | Stowe et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1 | 10/2012 | Gregurek et al. | |
| 2012/0261193 | A1 | 10/2012 | Swadi et al. | |
| 2013/0020084 | A1 | 1/2013 | Goodson | |
| 2013/0168151 | A1 * | 7/2013 | Grigor | E21B 23/04 175/81 |
| 2013/0199791 | A1 | 8/2013 | Hill, Jr. et al. | |
| 2013/0269928 | A1 | 10/2013 | Zhou | |
| 2013/0299160 | A1 | 11/2013 | Lott | |
| 2013/0341048 | A1 | 12/2013 | Delgado et al. | |
| 2014/0020904 | A1 | 1/2014 | Hill, Jr. et al. | |
| 2014/0318780 | A1 | 10/2014 | Howard | |
| 2015/0152703 | A1 | 6/2015 | Haun | |
| 2016/0238055 | A1 | 8/2016 | Donovan | |
| 2016/0348456 | A1 | 12/2016 | Laplante et al. | |
| 2017/0030168 | A1 | 2/2017 | Akkerman | |
| 2017/0306711 | A1 | 10/2017 | Hern et al. | |
| 2017/0328177 | A1 | 11/2017 | Sheehan et al. | |
| 2018/0209232 | A1 | 7/2018 | Hulsewe | |
| 2018/0209233 | A1 | 7/2018 | Hulsewe | |
| 2018/2009233 | | 7/2018 | Hulsewe | |
| 2018/0320480 | A1 | 11/2018 | Jelly et al. | |
| 2018/0334872 | A1 | 11/2018 | Vuyk | |
| 2019/0003264 | A1 * | 1/2019 | Swadi | E21B 29/002 |
| 2019/0106940 | A1 | 4/2019 | Korf et al. | |
| 2019/0120005 | A1 | 4/2019 | Hulsewe | |
| 2019/0330944 | A1 | 10/2019 | Crabb et al. | |
| 2020/0011134 | A1 | 1/2020 | Nevlud et al. | |
| 2020/0018131 | A1 | 1/2020 | Telfer et al. | |
| 2020/0088001 | A1 | 3/2020 | Morland | |
| 2020/0131886 | A1 * | 4/2020 | Hora | E21B 23/01 |

FOREIGN PATENT DOCUMENTS

| | | | |
|---|---|---|---|
| WO | 2006070204 | A2 | 7/2006 |
| WO | 2016209686 | A1 | 12/2016 |

OTHER PUBLICATIONS

C95400 Product Spec Sheet; Concast Metal Products, Jul. 27, 2010 (pp. 1-2).

C95510 Product Spec Sheet; Concast Metal Products, Dec. 22, 2010 (pp. 1-2).

International Search Report and Written Opinion for International Application No. PCT/US2021/023602; International Filing Date Mar. 23, 2021; Report dated Jul. 1, 2021 (pp. 1-7).

International Search Report and Written Opinion for International Application No. PCT/US2021/023603; International Filing Date Mar. 23, 2021; Report dated Jul. 1, 2021 (pp. 1-7).

International Search Report and Written Opinion for International Application No. PCT/US2021/023604; International Filing Date Mar. 23, 2021; Report dated Jul. 1, 2021 (pp. 1-9).

International Search Report and Written Opinion for International Application No. PCT/US2021/023605; International Filing Date Mar. 23, 2021; Report dated Jul. 1, 2021 (pp. 1-8).

International Search Report and Written Opinion for International Application No. PCT/US2021/023606; International Filing Date Mar. 23, 2021; Report dated Jul. 1, 2021 (pp. 1-7).

International Search Report and Written Opinion for International Application No. PCT/US2021/023609; International Filing Date Mar. 23, 2021; Report Mail Date Jul. 5, 2021 (pp. 1-10).

International Search Report and Written Opinion for International Application No. PCT/US2017/066117; International Filing Date Dec. 13, 2017; Report dated Mar. 29, 2018 (pp. 1-13).

International Search Report and Written Opinion for International Application No. PCT/US2017/066119; International Filing Date Dec. 13, 2017; Report dated Mar. 29, 2018 (pp. 1-10).

* cited by examiner

WINDOW MILL AND WHIPSTOCK CONNECTOR FOR A RESOURCE EXPLORATION AND RECOVERY SYSTEM

CROSS REFERENCE TO RELATED APPLICATIONS

The present application is a continuation-in-part of U.S. patent application Ser. No. 16/829,064 filed Mar. 25, 2020, which is incorporated in its entirety herein.

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, forming the window requires multiple trips into the well bore. Before the window is formed, tools are run into the well bore to clean well bore surfaces with a brush and/or a scraper. Other tools may be run in to either set or remove a bridge plug, and still other tools my be run in to map the window and monitor cement and casing integrity. After the tubular is prepared and the window location mapped, the window mill and whipstock are run in to cut the window. Each trip into the well bore requires time and incurs a cost. Therefore, the industry would welcome a system for cutting a casing window with out the need for multiple trips.

SUMMARY

Disclosed is a method of performing a well bore operation in a well bore. The method includes connecting a window mill to a whipstock connector forming a tubular section, supporting a tool below the whipstock connector, running the window mill, the whipstock connector, and the tool into the well bore, and axially loading the tool to perform the well bore operation.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
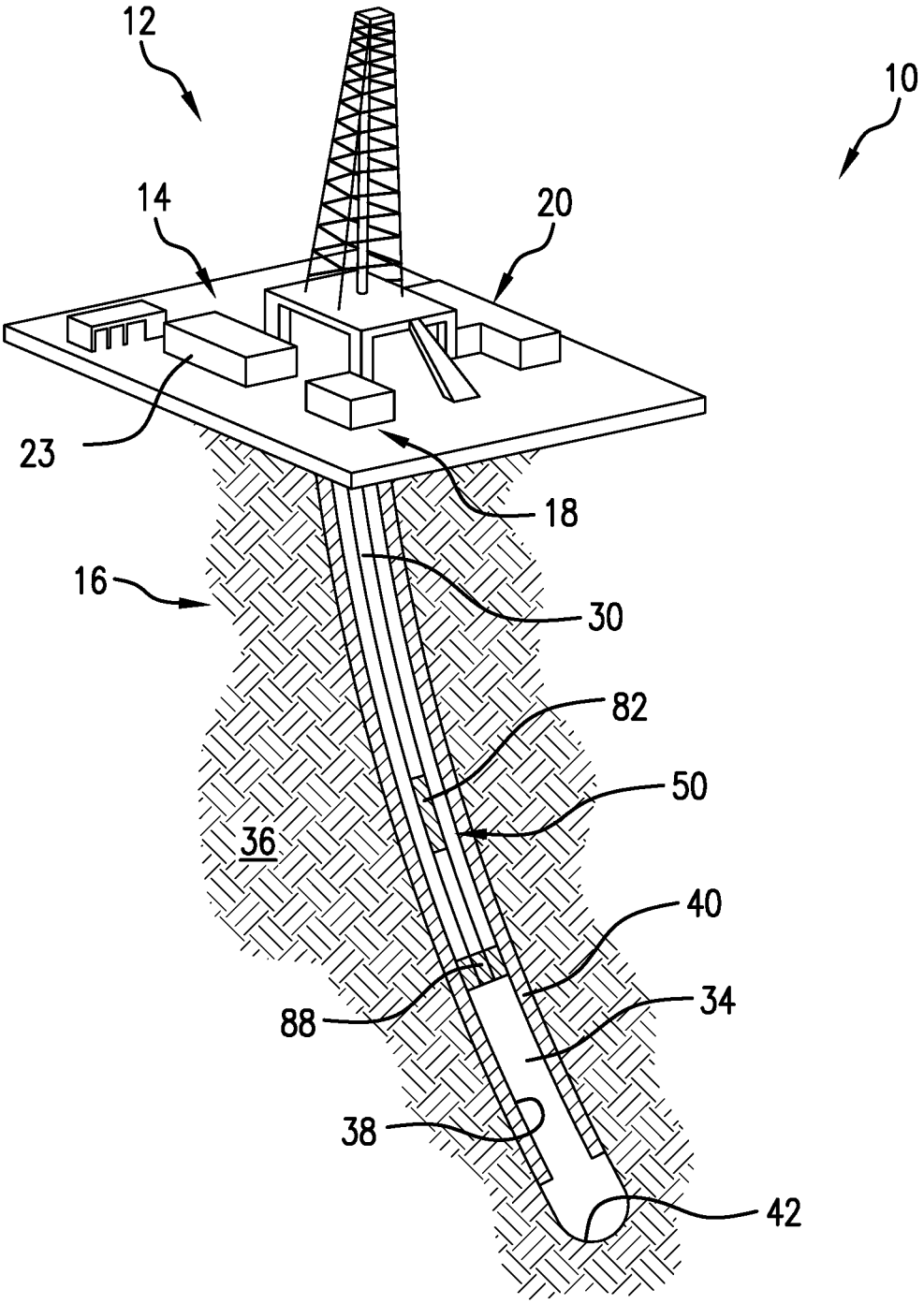
FIG. 1 depicts a resources exploration and recovery system including a window mill and whipstock connector, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
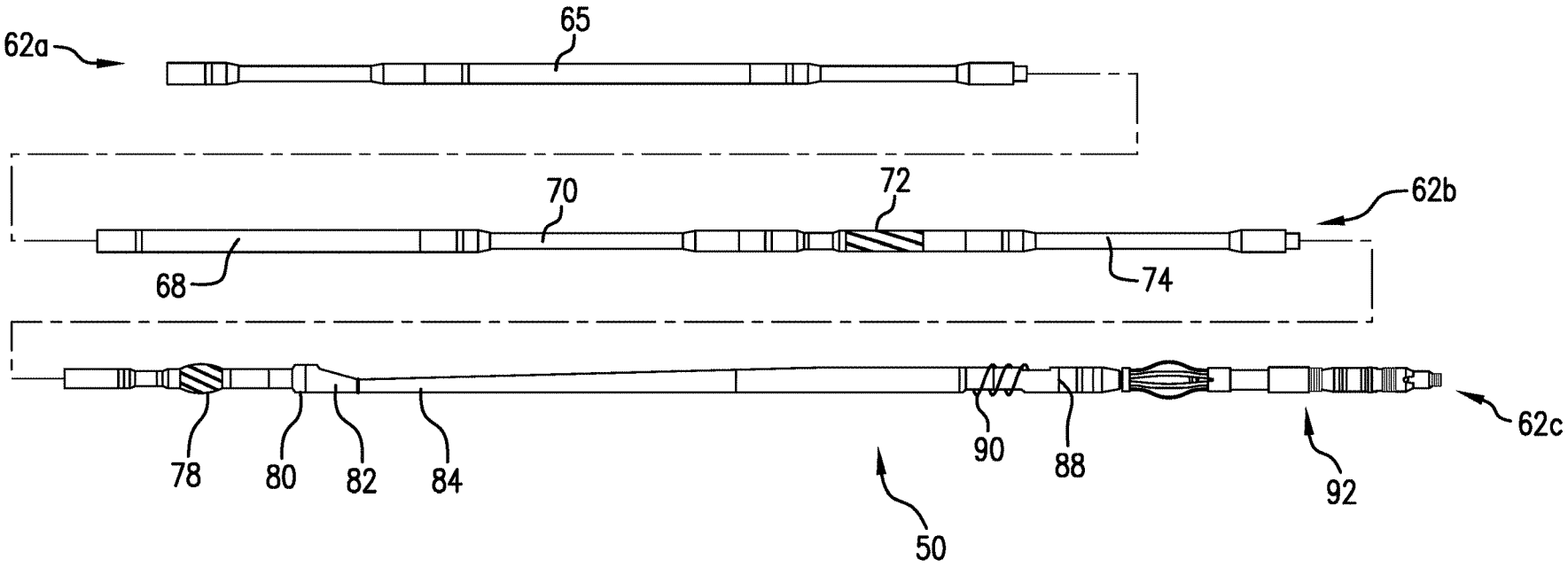
FIG. 2 depicts a window cutting system including a window mill and whipstock connector, in accordance with an exemplary embodiment.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b* and 62*c* as shown in FIG. 2. Each segment 62*a*, 62*b*, and 62*c* may be made up off-site and delivered to first system 12 for introduction into wellbore 34.

In an embodiment, first section 62*a* may support a measurement system 65, such as a measurement while drilling (MWD) system that includes various instrumentation systems that monitor window cutting operations. In another non-limiting example, measurement system 65 may take the form of a casing integrity/casing mapping (CICM) system that determine a location of connections, and maps the location for the window Of course, it should be understood, that other measurement systems may also be employed. Second segment 62*b* may include a whipstock valve 68, a first flex joint 70, an upper watermelon mill 72, and a second flex joint 74.

Third segment 62*c* may include a lower watermelon mill 78, a window mill 80, a whipstock connector 82, a whipstock 84, and an anchor 88. Whipstock connector 82 may be welded to whipstock 84. A brush or scraper 90 may be arranged on third segment 62*c* adjacent anchor 88. Third segment 62*c* may also include a bridge plug 92. Whipstock connector 82 serves as an interface between window mill 80 and whipstock 84 and the additional tools, e.g., anchor 88, scraper 90, bridge plug 92 and any other tools that may be arranged below whipstock 84. As will be detailed herein, whipstock connector 82 may support axial loads, rotational loads in one direction while also including frangible elements that allow for a separation of window mill 80 through rotation in a second direction.

Figure 3:
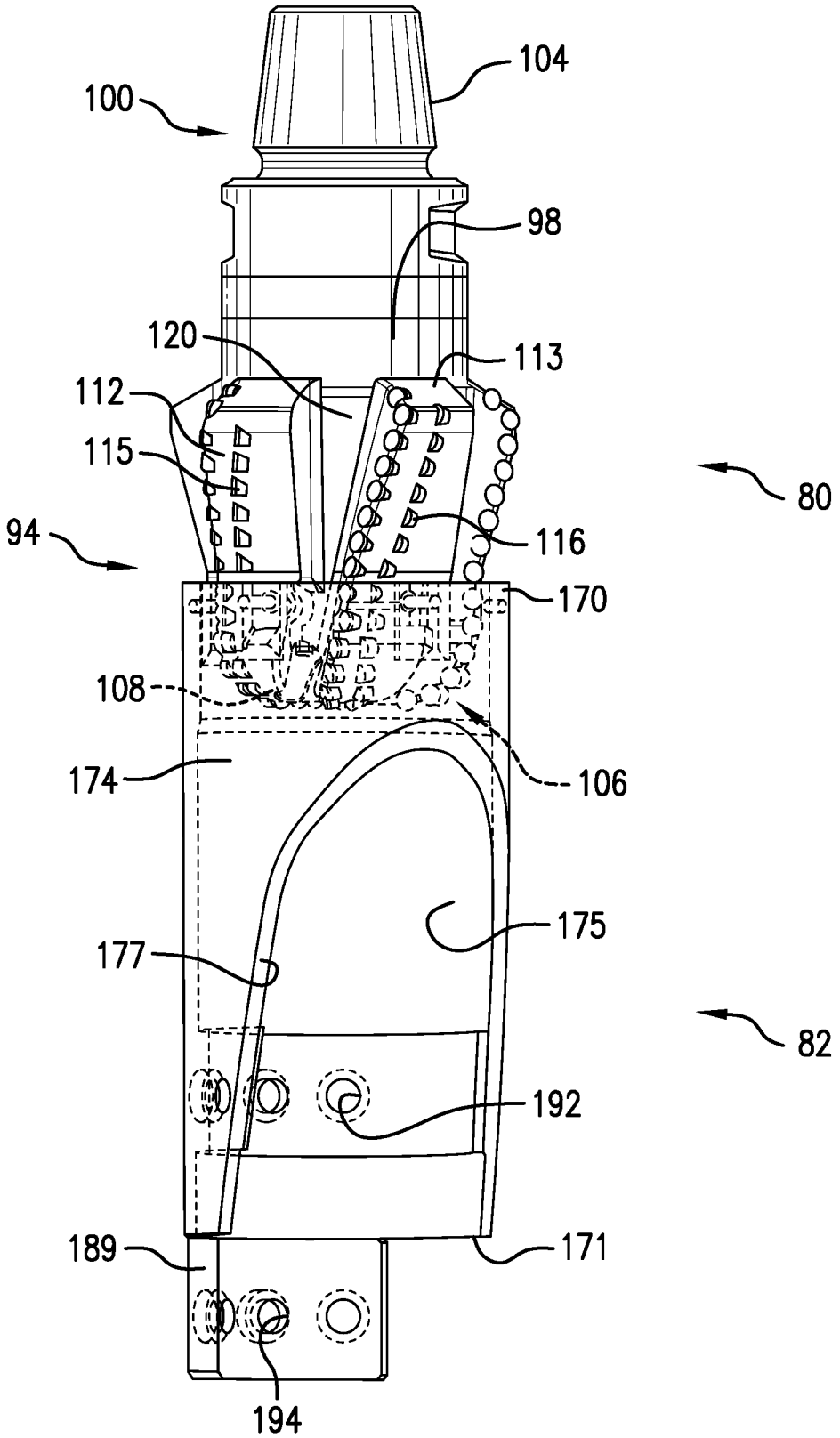
FIG. 3 depicts the window mill coupled to the whipstock connector, in accordance with an aspect of an exemplary embodiment.
Figure 4:
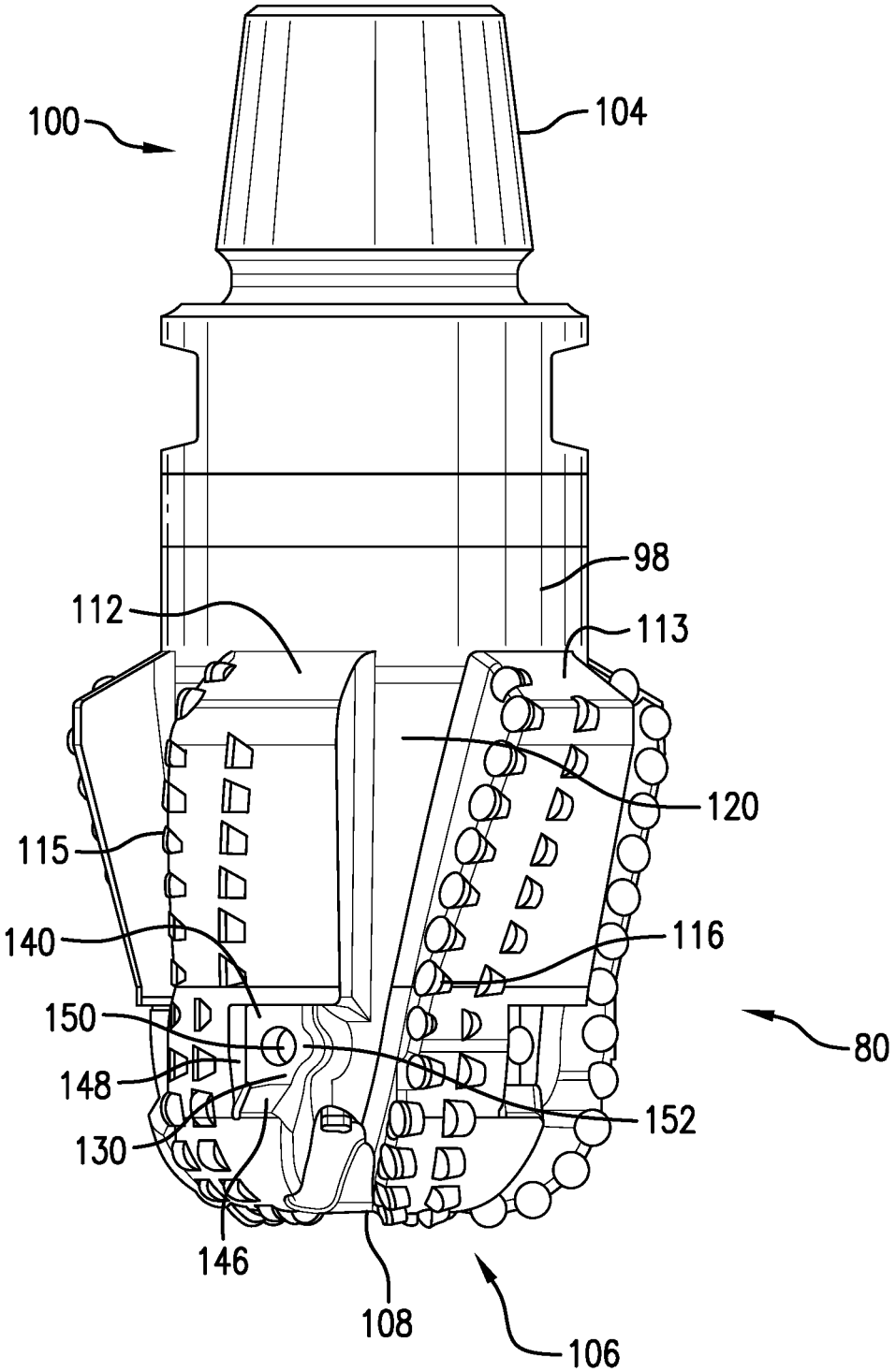
FIG. 4 depicts a window mill including a lug pocket, in accordance with an exemplary aspect.

Referring to FIGS. 3 and 4, window mill 80 is secured to whipstock connector 82 through a connection system 94 as will be detailed herein. In accordance with an exemplary aspect, window mill 80 includes a body 98 having a first end section 100 including a connector member 104 and a second end section 106 defining a tip portion 108. Connector member 104 provides an interface with lower watermelon mill 78 as shown in FIG. 2. Window mill 80 includes a plurality of blades, two of which are indicated at 112 and 113 that extend between first end section 100 and second end section 106. Each of the plurality of blades 112, 113 include a plurality of cutting elements indicated at 115 and 116 respectively. In the embodiment shown, a gap or junkslot 120 is defined between adjacent ones of the plurality of blades 112 and 113. At this point, it should be understood that while two blades are referenced, additional blades are present and the number of blades on body 98 may vary.

Figure 5:
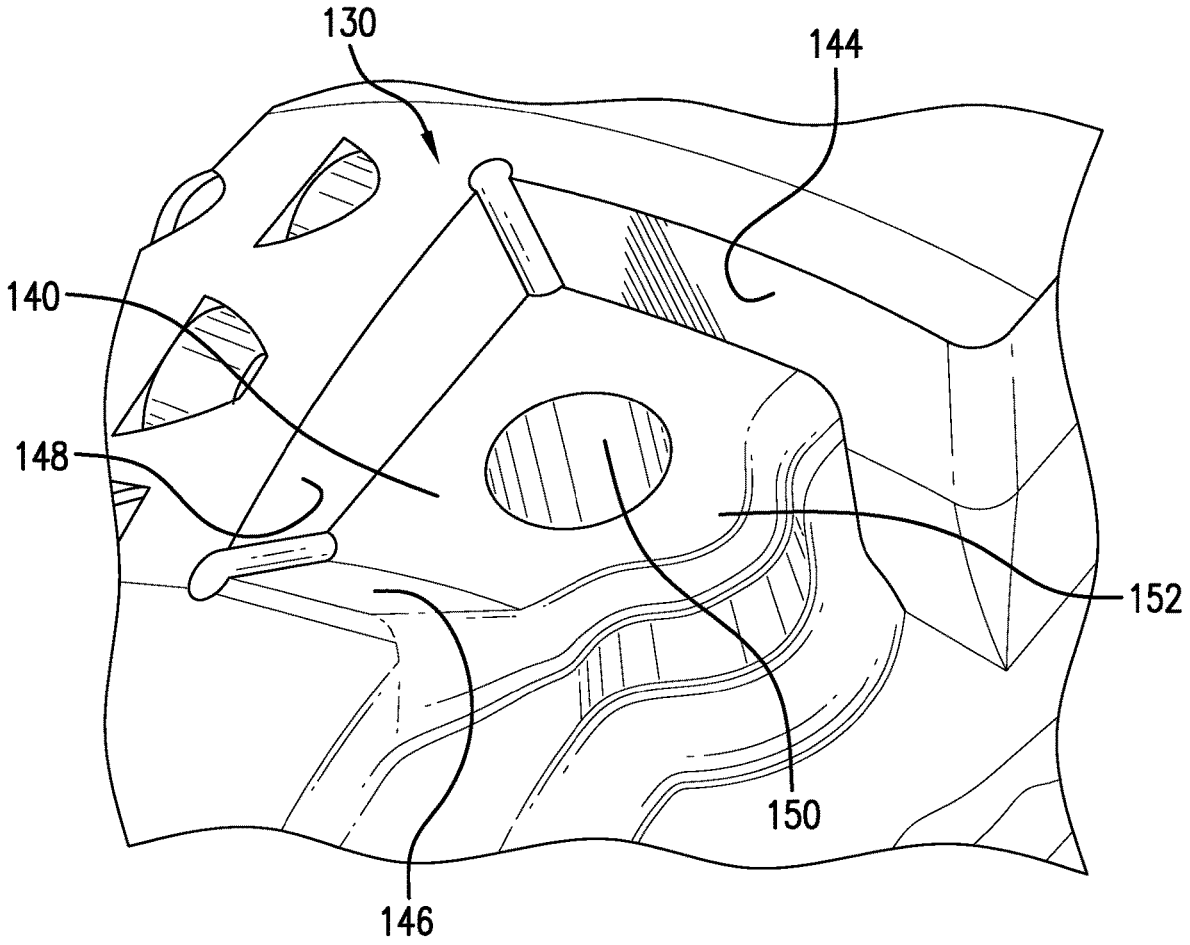
FIG. 5 is a detail view of the lug pocket of FIG. 4, in accordance with an exemplary embodiment.

In accordance with an exemplary embodiment, window mill 80 includes a plurality of lug pockets, one of which is indicated at 130 that provide an interface with whipstock connector 82 as will be detailed herein. Each lug pocket 130 is formed in a corresponding one of the plurality of blades 112, 113 and others. Referring to FIG. 5, each lug pocket 130 includes a base wall 140, a first side wall 144, a second side wall 146 and a connecting wall 148. The geometry of each lug pocket allows segment 62*c* to support whipstock connector 82 when being raised for insertion into wellbore 34.

Figure 6:
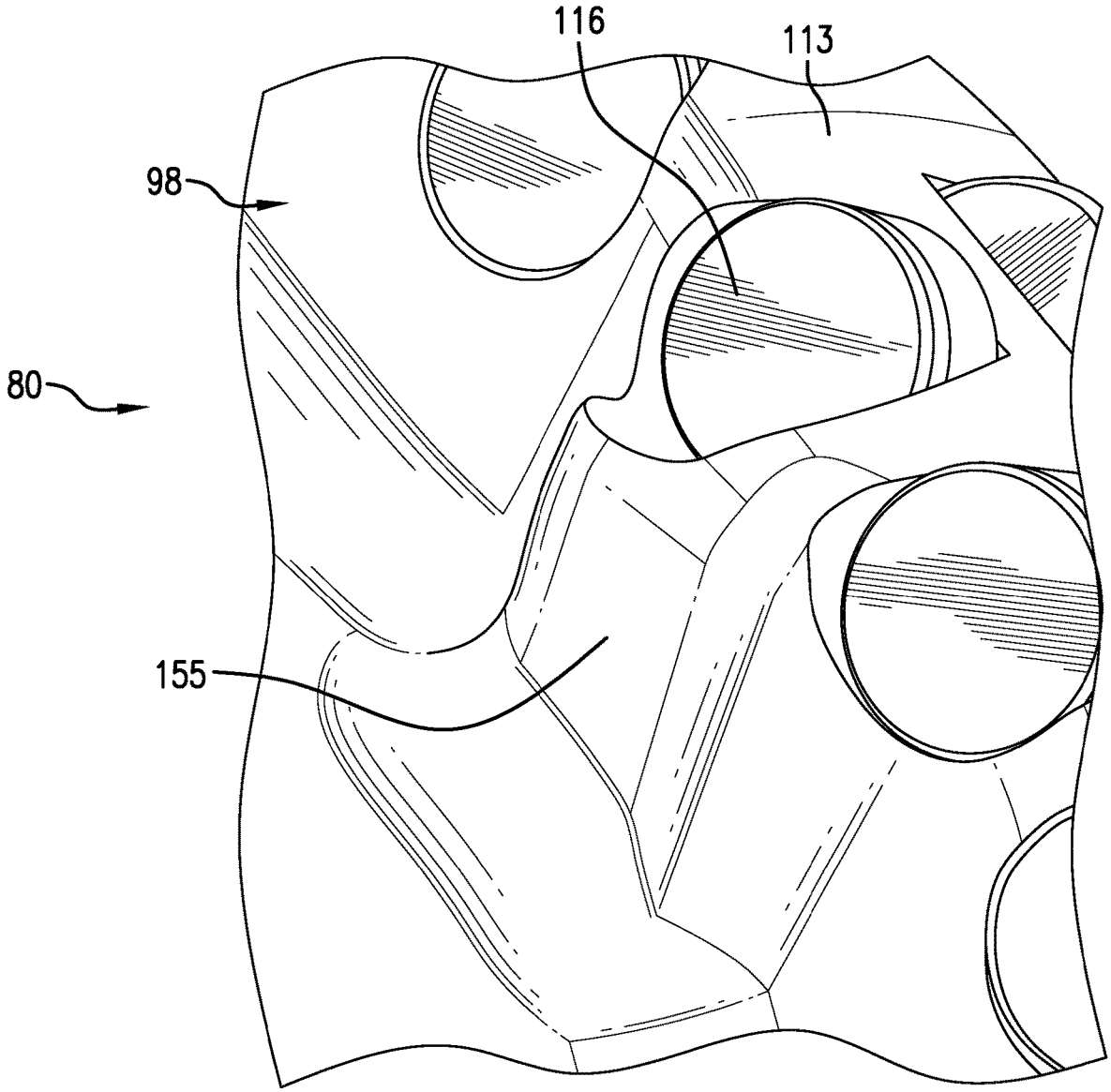
FIG. 6 depicts additional material added at a blade of the window mill of FIG. 4, in accordance with an aspect of an exemplary embodiment.

First side wall 144 is closer to first end section 100 than second side wall 146. Base wall 140 includes a recess 150. Second side wall 146 includes an angled or chamfered surface (not separately labeled). Base wall 140 also includes an extended region 152 that protrudes toward gap 120. Extended region 152 provides additional material around recess 150 to enhance load carrying capability of lug pocket 130. In addition, each of the plurality of blades includes an increased thickness zone or impact stop 155 such as shown on blade 113 in FIG. 6. Increased thickness zone 155 provides protection for cutting elements 116 when window mill 80 is released from whipstock connector 82 as will be detailed herein. Increased thickness zone 155 also shields blade 113 from torque loads that could damage cutting elements 115 and 116. In addition, the plurality of blades is asymmetrical so as to allow window mill 80 to key into whipstock connector 82 in a selected orientation.

Figure 7:
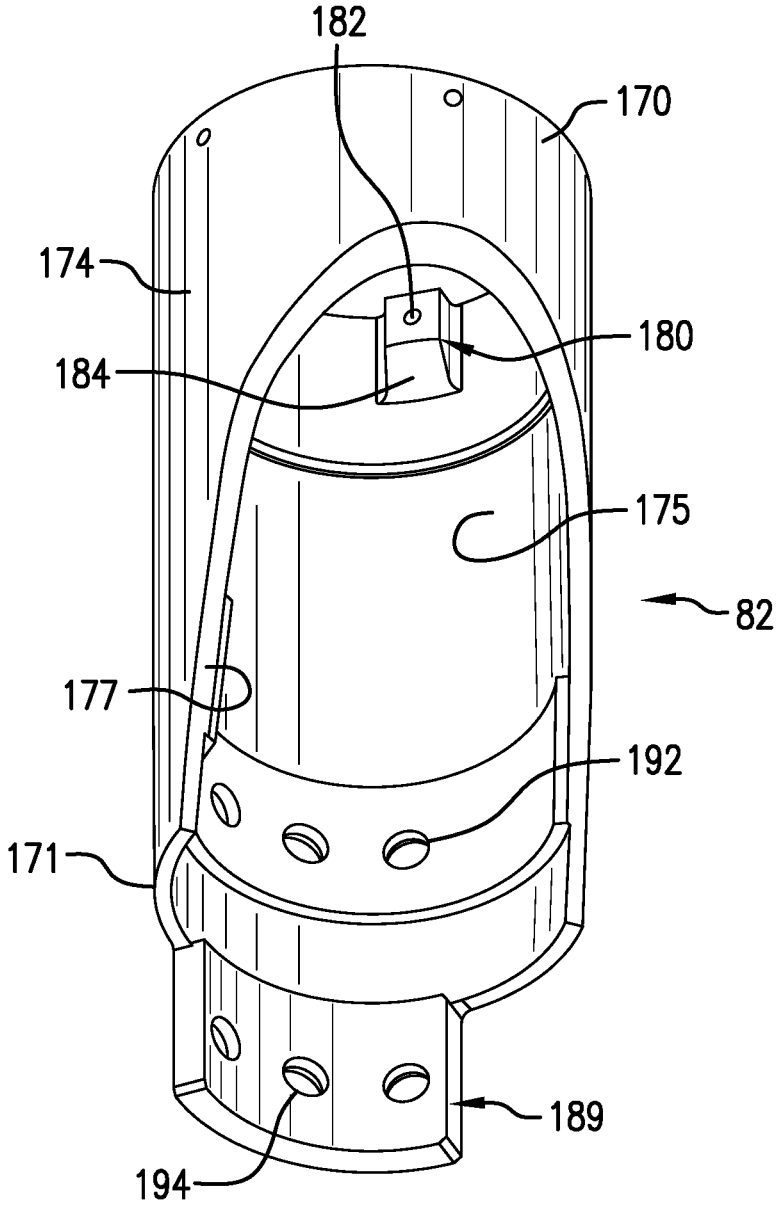
FIG. 7 depicts a perspective view of a first end of the whipstock connector of FIG. 3, in accordance with an exemplary aspect.
Figure 8:
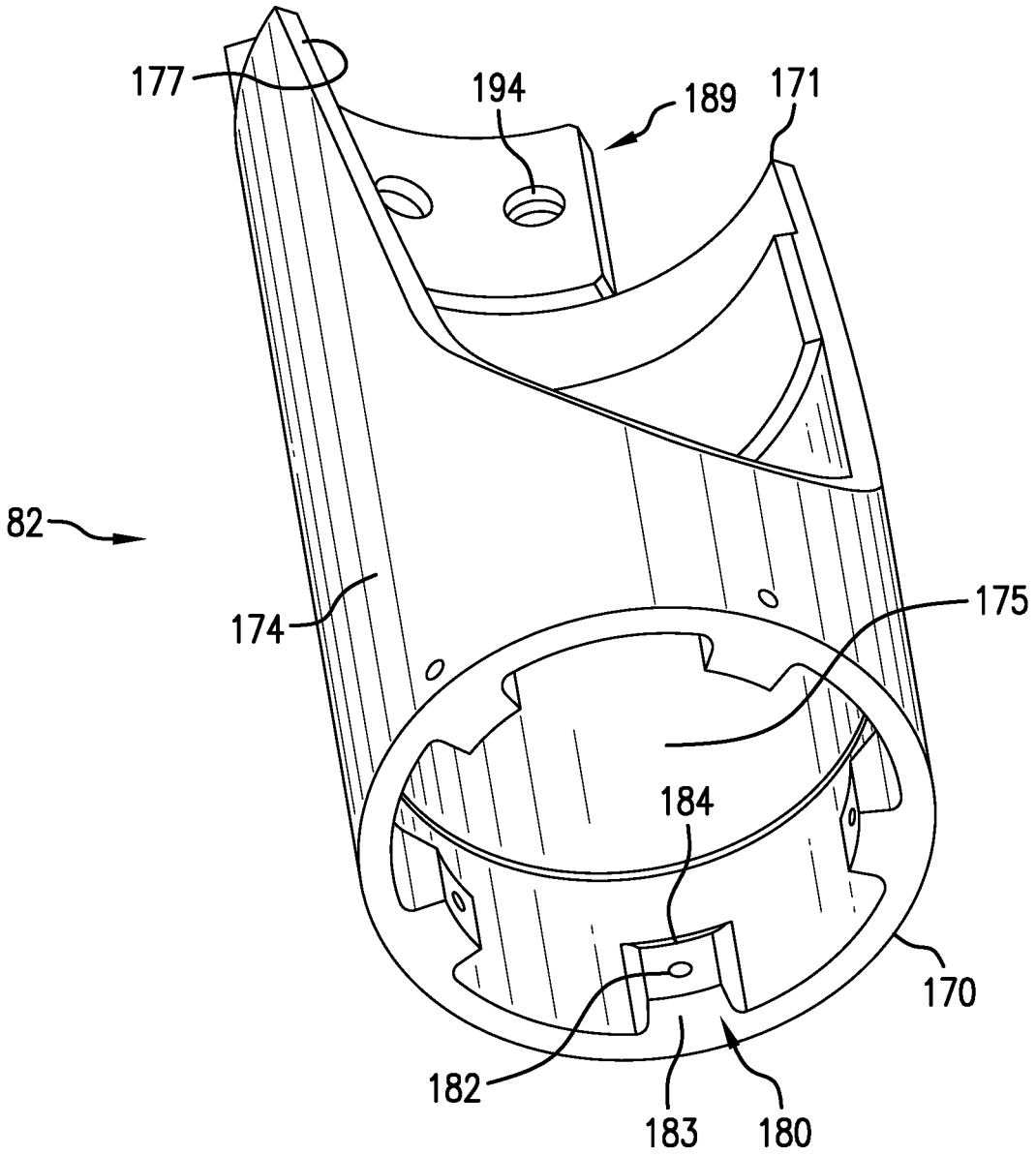
FIG. 8 depicts a perspective view of a second end of the whipstock connector of FIG. 3, in accordance with an exemplary aspect.

Reference will now follow to FIGS. 7 and 8 in describing whipstock connector 82 in accordance with an aspect of an exemplary embodiment. Whipstock connector 82 includes a first end 170 and a second end 171. Whipstock connector 82 also includes an outer surface 174 and an inner surface 175. An opening 177 is formed in whipstock connector 82. Opening 177 extends from second end 171 toward first end 170.

In accordance with an exemplary aspect, whipstock connector 82 includes a plurality of lugs, one of which is indicated at 180, that project radially inwardly from inner surface 175. Each lug 180 includes a radially extending threaded passage 182, a first surface 183 arranged at first end 170 and an opposing angled surface 184. Each lug 180 is received in a corresponding one of lug pockets 130 such that angled surface 184 rests upon the chamfer (not separately labeled) formed on second side wall 146. First surface 183 cooperates with first side wall 144 and acts as a travel limiter that prevents window mill 80 from inserting too far into whipstock connector 82.

Figure 9:
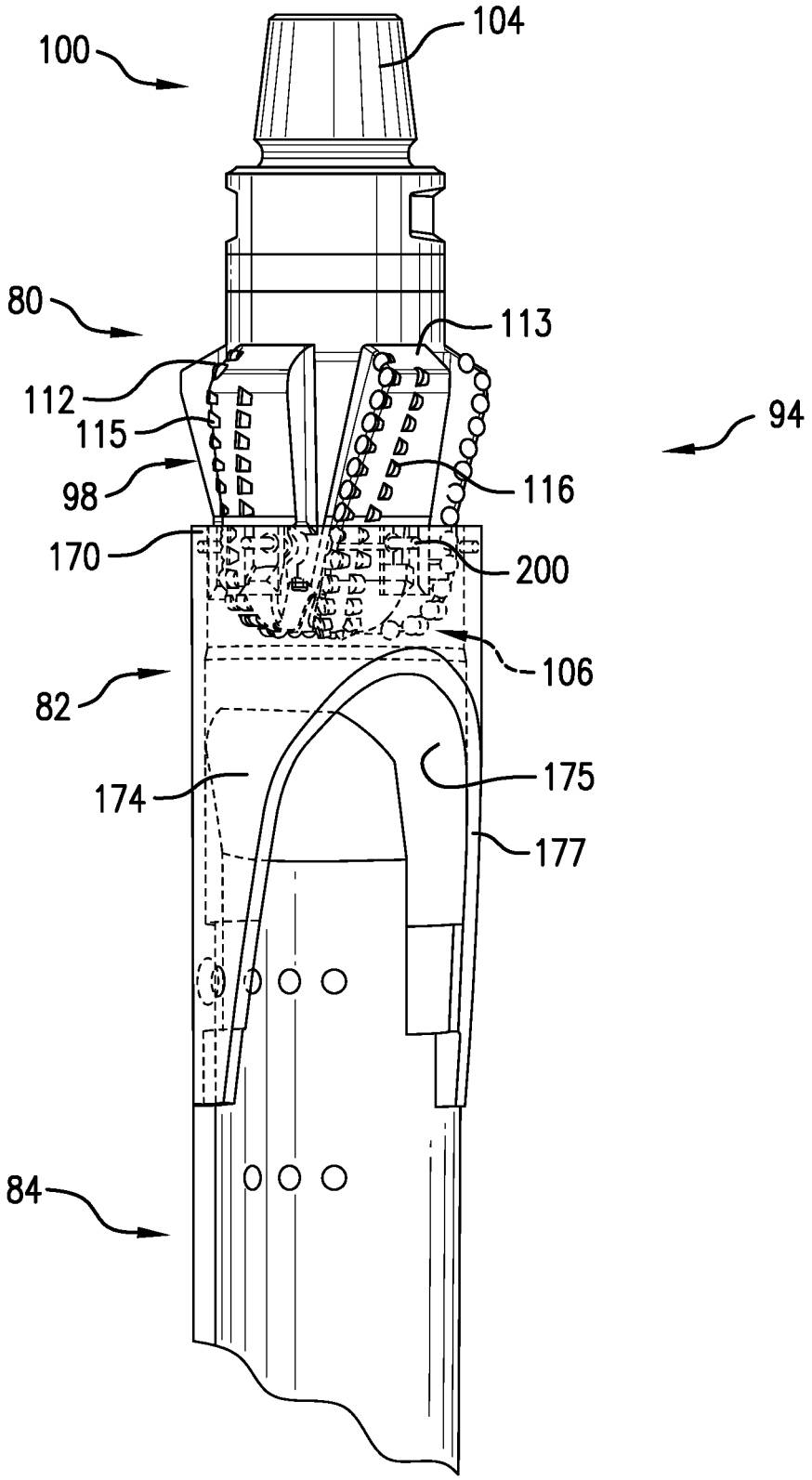
FIG. 9 depicts the window mill and whipstock connector of FIG. 3 connected to a whipstock, in accordance with an aspect of an exemplary embodiment.

Whipstock connector 82 also includes a tab element 189. A first plurality of openings 192 may extend through whipstock connector 82 at a position spaced from second end 171. A second plurality of openings 194 may extend through tab element 189. First and second pluralities of openings 192 and 194 may receive mechanical fasteners separately labeled) that secure whipstock connector 82 to whipstock 84 as shown in FIG. 9. Of course, it should be understood that other mechanisms, such as welding, and the like may be used to join whipstock connector 82 to whipstock 84.

In accordance with an exemplary aspect, third tubular segment 62*c* may be assembled off-sight and delivered to, for example, first system 12. Window mill 80 may be installed into first end 170 of whipstock connector 82. Window mill 80 may be rotated to align lugs 180 with, and nest into lug pockets 130. The direction of rotation may be clockwise from above. However, it should be understood that the direction of rotation may vary. At this point, a frangible bolt 200 (FIG. 9) may be threaded into each passage 182 and engaged with a corresponding one of recesses 150. At this point it should be understood that either passage 182 or recess 150 may be threaded to retain frangible bolt 200. When ready to be installed into wellbore 34, third tubular segment 62*c* may be hoisted and lowered into position and held at a rotary table (not shown). Second tubular segment 62*b* may be brought into position and connected with third tubular segment 62*c*.

The remaining portions of tubular string 30, including first tubular segment 62*a*, may be connected and window cutting system 50 lowered into wellbore 34. Engagement between first wall 183 of each lug 180 and corresponding ones of first and second side walls 144 and 146 of each lug pocket 130 supports high push and pull forces associated with tripping in tubular string 30 to a desired depth. Once in position, anchor 88 may be deployed and, in accordance with an exemplary aspect, a clockwise rotary force imparted to window mill 80 causing frangible bolts 200 to shear. The rotary force may take the form of an anti-clockwise direction from above. At this point, a window cutting operation may commence.

With this arrangement, lug pockets 130 may support each lug 180 when third tubular segment 62*c* is raised and hoisted into position. The interaction of lugs 180 with lug pockets 130 ensure that frangible bolts 200 are not exposed to any forces that would cause a premature separation of window mill 80 and whipstock connector 82. Further, the mating of angled surface 184 on each lug with the chamfer on each second side wall 146 provides increased load carrying capacity. By allowing third tubular segment 62*c* to be assembled in this manner reduces time and effort at first system 12 thereby enhancing operational efficiencies.

For example, the window mill may be attached to the whipstock prior to picking up and deploying into the wellbore. Further, the connection between the window mill and the whipstock in accordance with exemplary embodiments allow string 30 to be rotated at 40 RPM or above during run-in. Further, the high push-pull capability allows for the use of telemetry to verify window mill location as well as the use (rotation and reciprocation) of brush and/or scraper 90 during deployment.

Figure 10A:
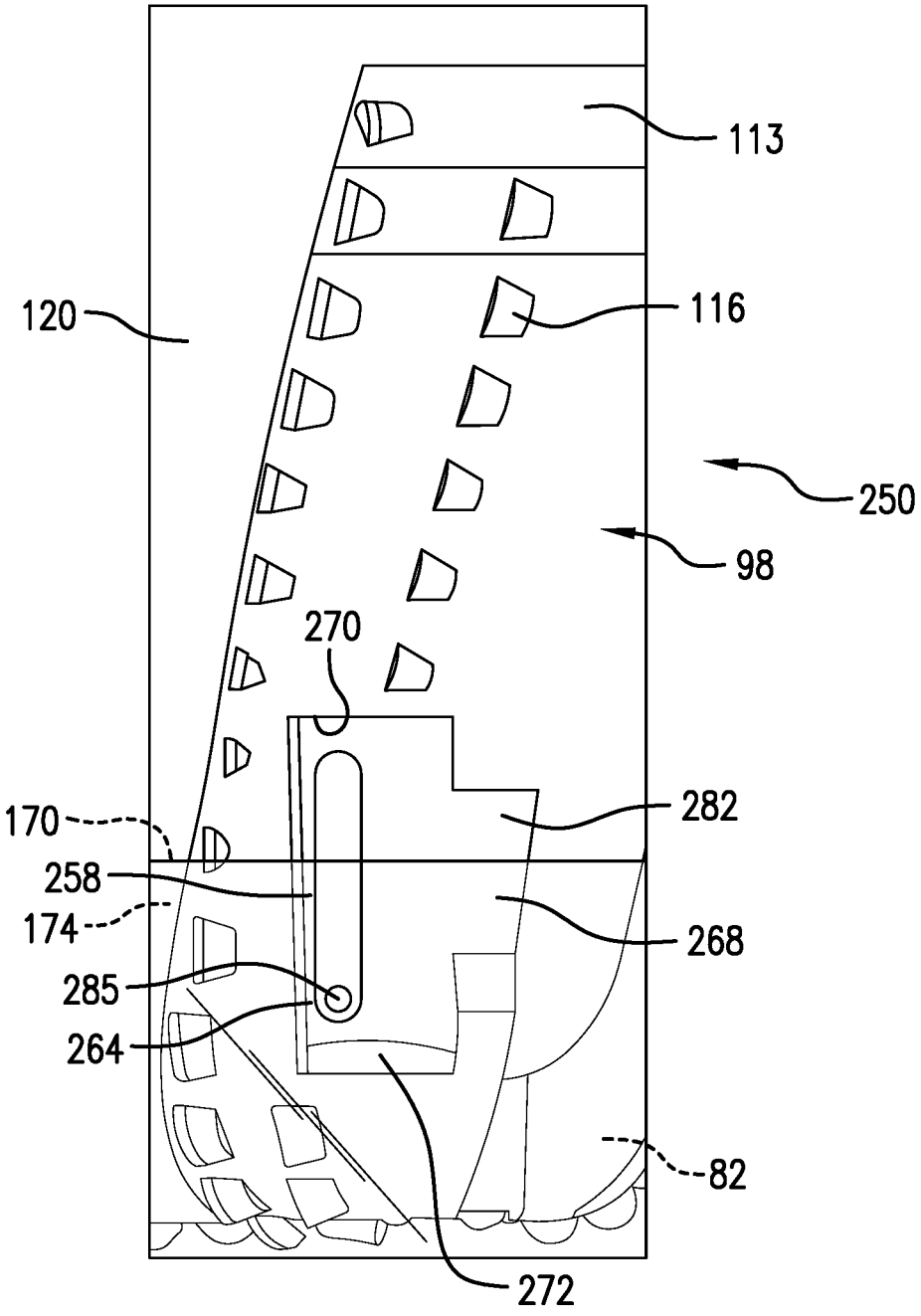
FIG. 10A depicts release system for a window mill and whipstock connector showing the whipstock connector hanging from the window mill in a torque application position, in accordance with another aspect of an exemplary embodiment.
Figure 10B:
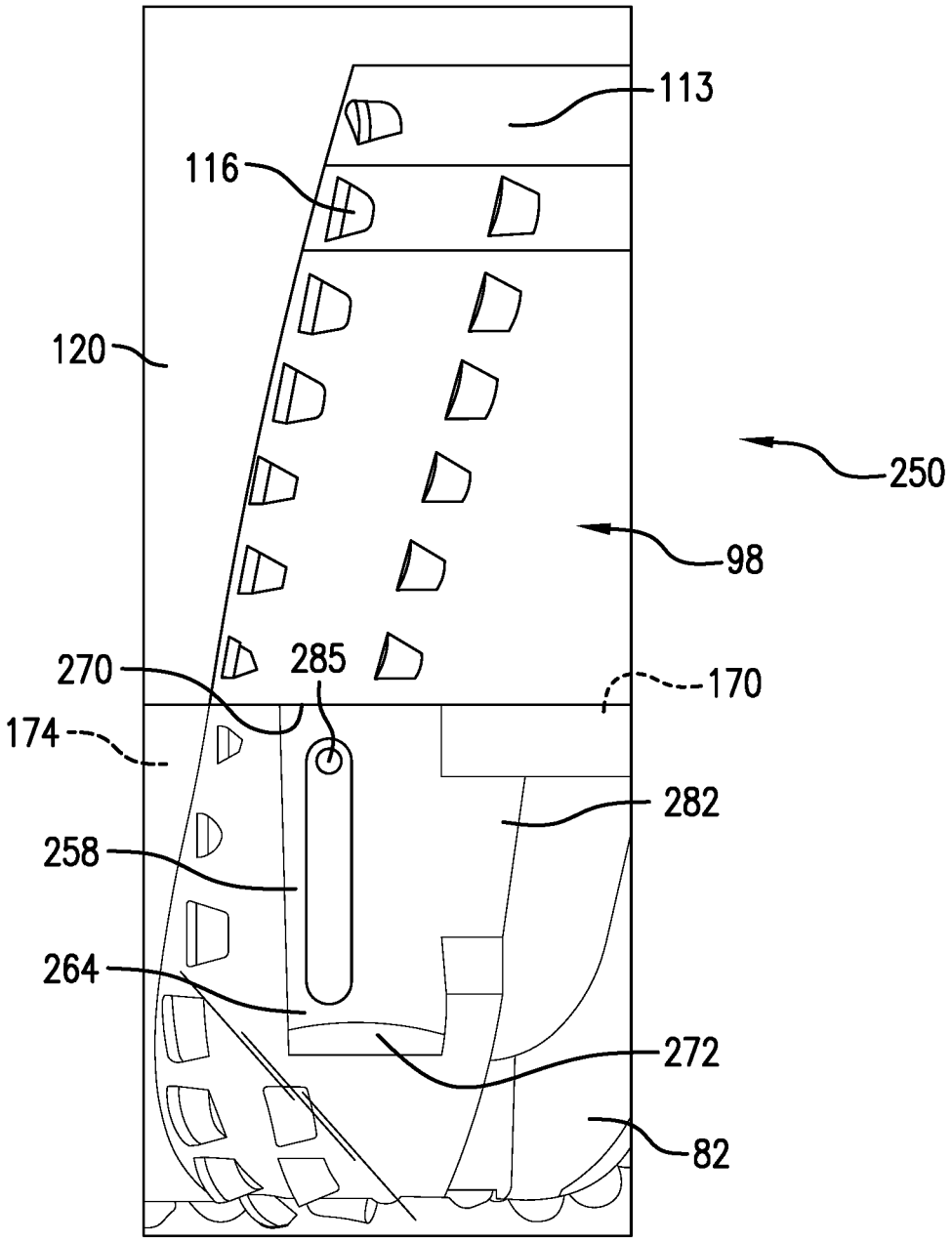
FIG. 10B depicts release system for a window mill and whipstock connector of FIG. 10A in run-in position with the window mill pushing on the whipstock connector.
Figure 10C:
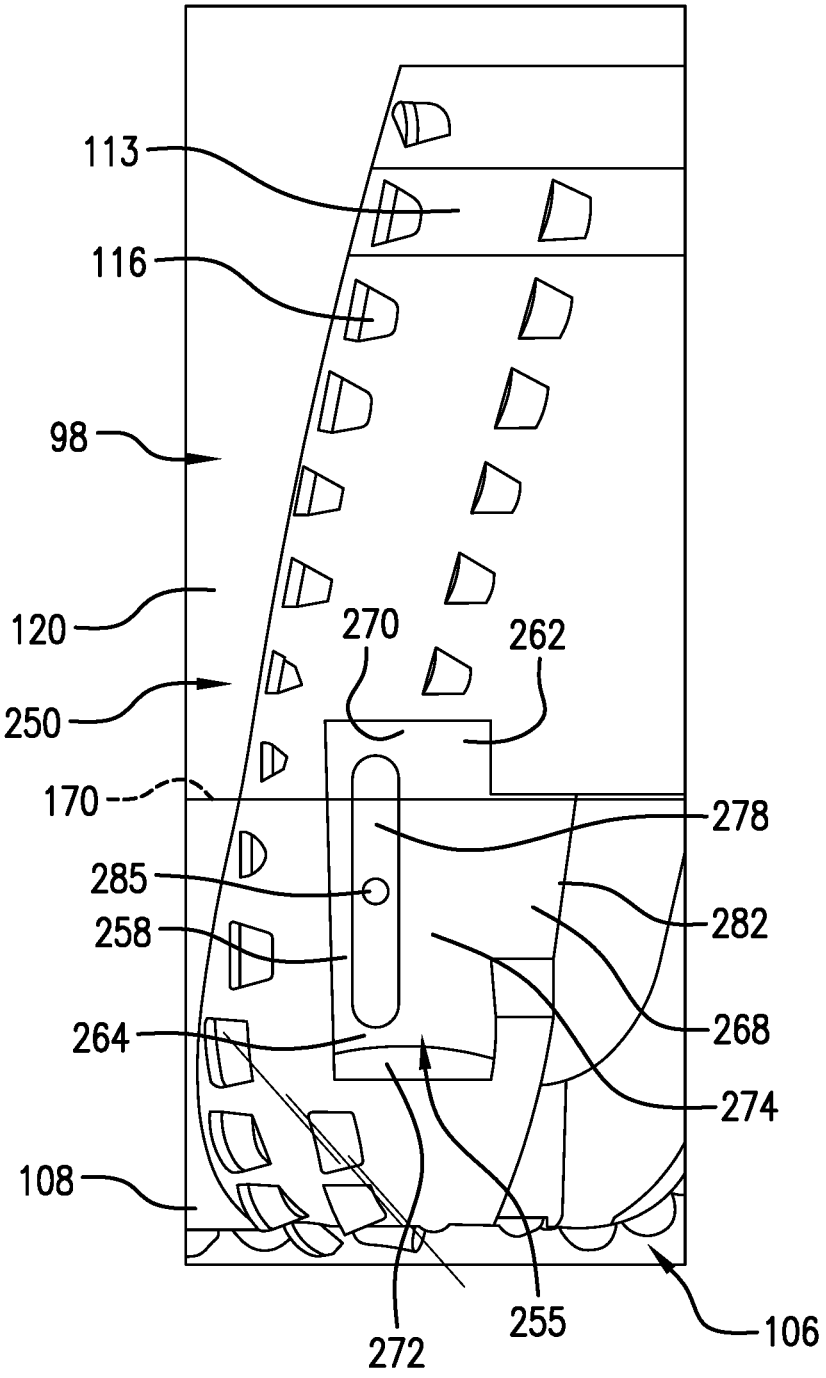
FIG. 10C depicts release system for a window mill and whipstock connector of FIG. 10A in a pre-release position.

Reference will now follow to FIGS. 10A-10C, wherein like reference numbers represent corresponding parts in the respective views, in describing a window mill 250 in accordance with another aspect of an exemplary embodiment. Window mill 250 includes a plurality of lug pockets, one of which is indicated at 255 that provide an interface with whipstock connector 82 as will be detailed herein. Each lug pocket 255 is formed in a corresponding one of the plurality of blades 112, 113 and others.

In the exemplary embodiment shown, each lug pocket 255 is generally T-shaped having a longitudinally extending leg 258 including a first or upper leg portion 262, an opposing second or lower leg portion 264, and a branch leg 268. Branch leg extends substantially perpendicularly from longitudinally extending leg 258 between first leg portion 262 and second leg portion 264. First leg portion 262 includes an upper wall 270 and second leg portion 264 includes a lower wall 272. A base wall 274 extends between upper wall 270 and lower wall 272. Base wall 274 extends into window mill 250 a first depth and includes a longitudinally extending slot 278.

In further accordance with an exemplary aspect, branch leg 268 extends outwardly between first leg portion 262 and second leg portion 264 and includes an angled base wall 282 that extends from the first depth of base wall 274 radially outwardly toward a surface (not separately labeled) of window mill 250. As will be detailed herein, angled base wall 282 defines a ramp that allows, for example, lug 180 to transition out of lug pocket 255.

Window mill 250 is coupled to whipstock connector 82 such that each lug 180 enters branch leg 268. Whipstock connector 82 and/or window mill 250 is rotated such that each lug settles between upper wall 270 and lower wall 272. A frangible fastener 285 is threshed into threaded passage 182. Fastener 285 passes through lug 180 and extends into slot 278. With this arrangement, lug 180 is constrained in lug pocket 255 and may travel between upper wall 270 and lower wall 272.

When ready to be installed into wellbore 34, third tubular segment 62*c* may be hoisted and lowered into position and held at a rotary table (not shown). Second tubular segment 62*b* may be brought into position and connected with third tubular segment 62*c*. First tubular segment 62*a* may then be connected with second tubular segment 62*b* and tubular string 30 run into wellbore 34 to a selected depth at which point anchor 88 may be set.

During run in, it may be desirable to axially load tubular string 30 in compression and/or tension. In compression, lug 180 may travel into first leg portion 262 and abut upper wall 270 as shown in FIG. 10B. In tension, lug 180 may travel into second leg portion 264 and abut lower wall 272. With this arrangement, the window mill 250/whipstock connector 82 can withstand high loading in both tension and compression. Further, window mill 250 may be rotated such that lug 180 engages side surfaces (not separately labeled) of first leg portion 262 or second leg portion 264 as shown in FIG. 10C. First and second legs 262 and 264 enable window mill and whipstock 84 to withstand high rotary loads under both clockwise and counter-clockwise rotation. Thus, tubular string may be manipulated to clean internal surfaces of casing 40 with scraper or brush 90.

After setting anchor 88 may be desired to separate window mill 250 and whipstock connector 82, lug 180 is positioned adjacent to branch leg 268 such as by lifting up or slacking off on tubular string 30. A rotary force is applied to window mill 250 causing frangible fastener 285 to fail, e.g., break shear etc. Lug 180 may then transition up angled base wall 282 and pass out of lug pocket 255. Tubular string 30 may then be lifted to separate window mill 250 from whipstock connector 82.

Figure 11A:
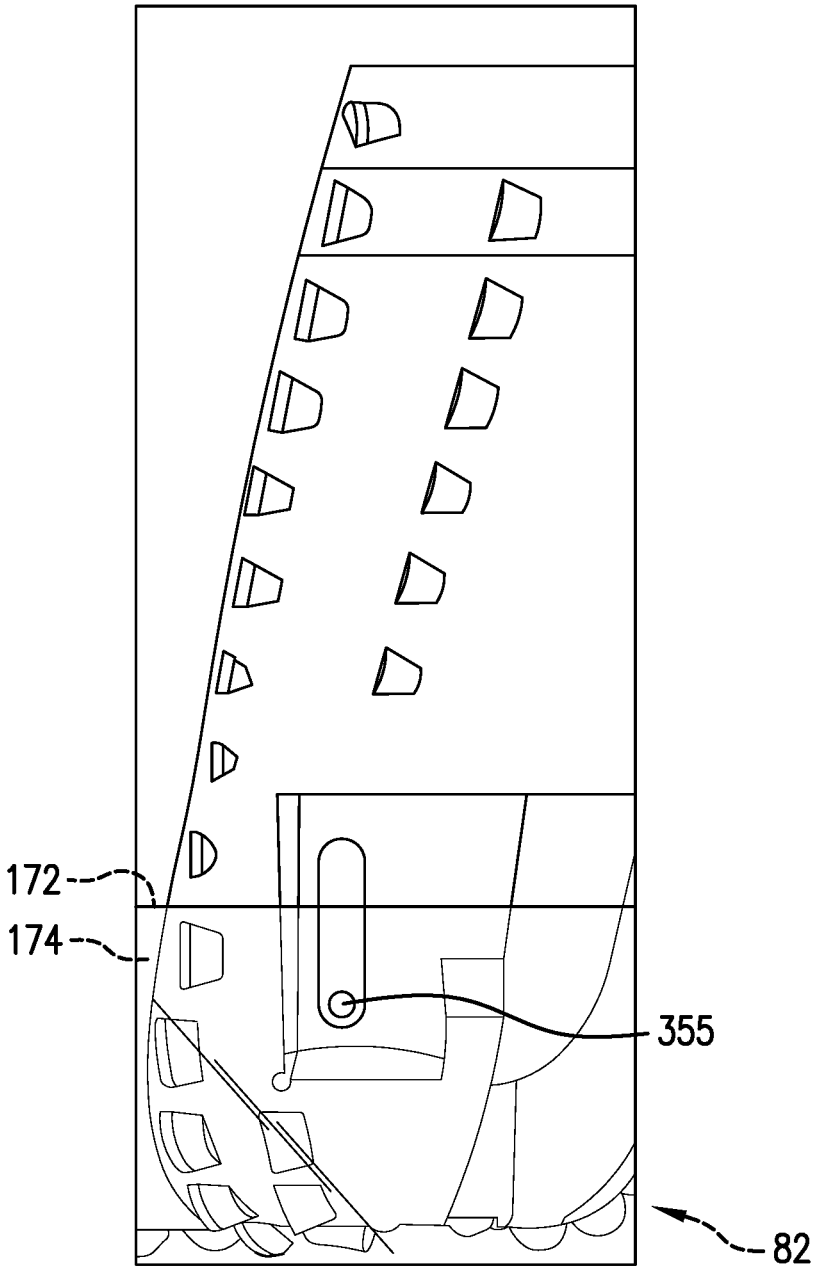
FIG. 11A depicts release system for a window mill and whipstock connector showing the whipstock connector hanging from the window mill in a torque application position, in accordance with yet another aspect of an exemplary embodiment.
Figure 11B:
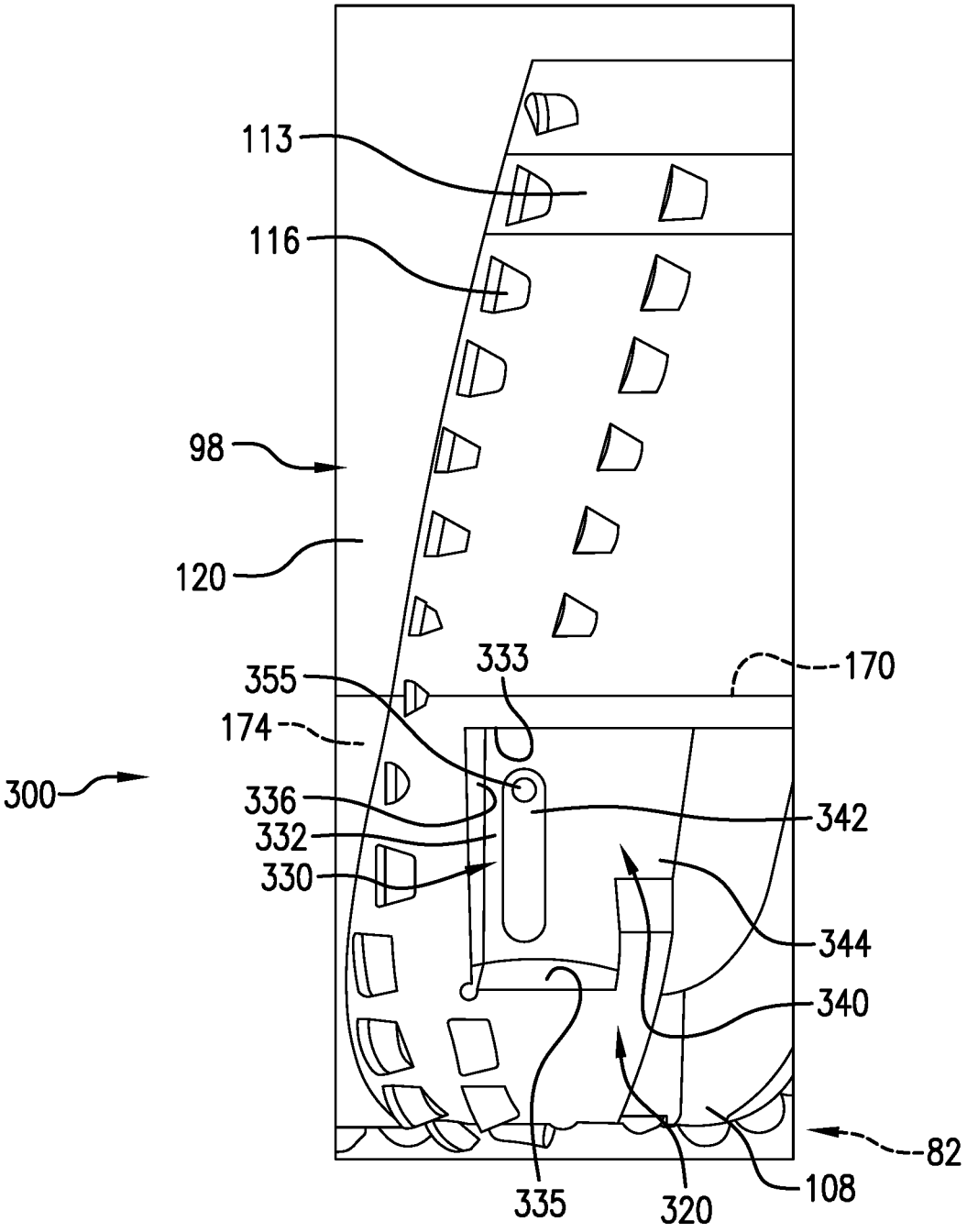
FIG. 11B depicts release system for a window mill and whipstock connector of FIG. 11A in a pre-release position.

Reference will now follow to FIGS. 11A-11B, wherein like reference numbers represent corresponding parts in the respective views, in describing a window mill 300 in accordance with yet another exemplary embodiment. Window mill 300 includes a plurality of lug pockets, one of which is indicated at 320 that provide an interface with whipstock connector 82 as will be detailed herein. Each lug pocket 320 is formed in a corresponding one of the plurality of blades 112, 113 and others.

In the exemplary embodiment shown, each lug pocket 320 has a generally inverted L-shape and includes a longitudinally extending leg 330 including a base wall 332, an upper wall 333, a lower wall 335, and a side wall 336. A branch leg 340 extends substantially perpendicularly outwardly of longitudinally extending leg 330 adjacent to upper wall 333. Base wall 332 extends between upper wall 333 and lower wall 335. Base wall 332 extends into window mill 300 a first depth and includes a longitudinally extending slot 342.

In further accordance with an exemplary aspect, branch leg 340 includes an angled base wall 344 that extends from the first depth of base wall 336 radially outwardly toward a surface (not separately labeled) of window mill 300. As will be detailed herein, angled base wall 344 defines a ramp that allows, for example, lug 180 to transition out of lug pocket 320.

Window mill 300 is coupled to whipstock connector 82 such that each lug 180 enters branch leg 340. Whipstock connector 82 and/or window mill 300 is rotated such that each lug 180 settles between upper wall 333 and lower wall 335. A frangible fastener 355 is threshed into threaded passage 182. Fastener 355 passes through lug 180 and extends into slot 342. With this arrangement, lug 180 is constrained in lug pocket 320 and may travel between upper wall 333 and lower wall 335.

When ready to be installed into wellbore 34, third tubular segment 62*c* may be hoisted and lowered into position and held at a rotary table (not shown). Second tubular segment 62*b* may be brought into position and connected with third tubular segment 62*c*. First tubular segment 62*a* may then be connected with second tubular segment 62*b* and tubular string 30 run into wellbore 34 to a selected depth at which point anchor 88 may be set.

During run in, it may be desirable to axially load tubular string 30 in compression and/or tension. In compression, lug 180 may travel toward and engage upper wall 333 as shown in FIG. 11B. In tension, lug 180 may travel toward and engage lower wall 335. With this arrangement, the window mill 300/whipstock connector 82 can withstand high loading in both tension and compression. Further, window mill 300 may be rotated such that lug 180 engages side surfaces (not of lug pocket 320 at lower wall 335. Side surface of longitudinal slot 342 at lower wall 335 enables window mill and whipstock 84 to withstand high rotary loads under both clockwise and counter-clockwise rotation. Thus, tubular string may be manipulated to clean internal surfaces of casing 40 with scraper or brush 90.

After setting anchor 88 it may be desired to separate window mill and whipstock connector 82, lug 180 is positioned adjacent to upper wall 333 such as by slacking off on tubular string 30. A rotary force is applied to window mill 300 causing frangible fastener 355 to fail, e.g., break shear etc. Lug 180 may then transition up angled base wall 344 and pass out of lug pocket 320. Tubular string 30 may then be lifted to separate window mill 300 from whipstock connector 82.

Figure 12A:
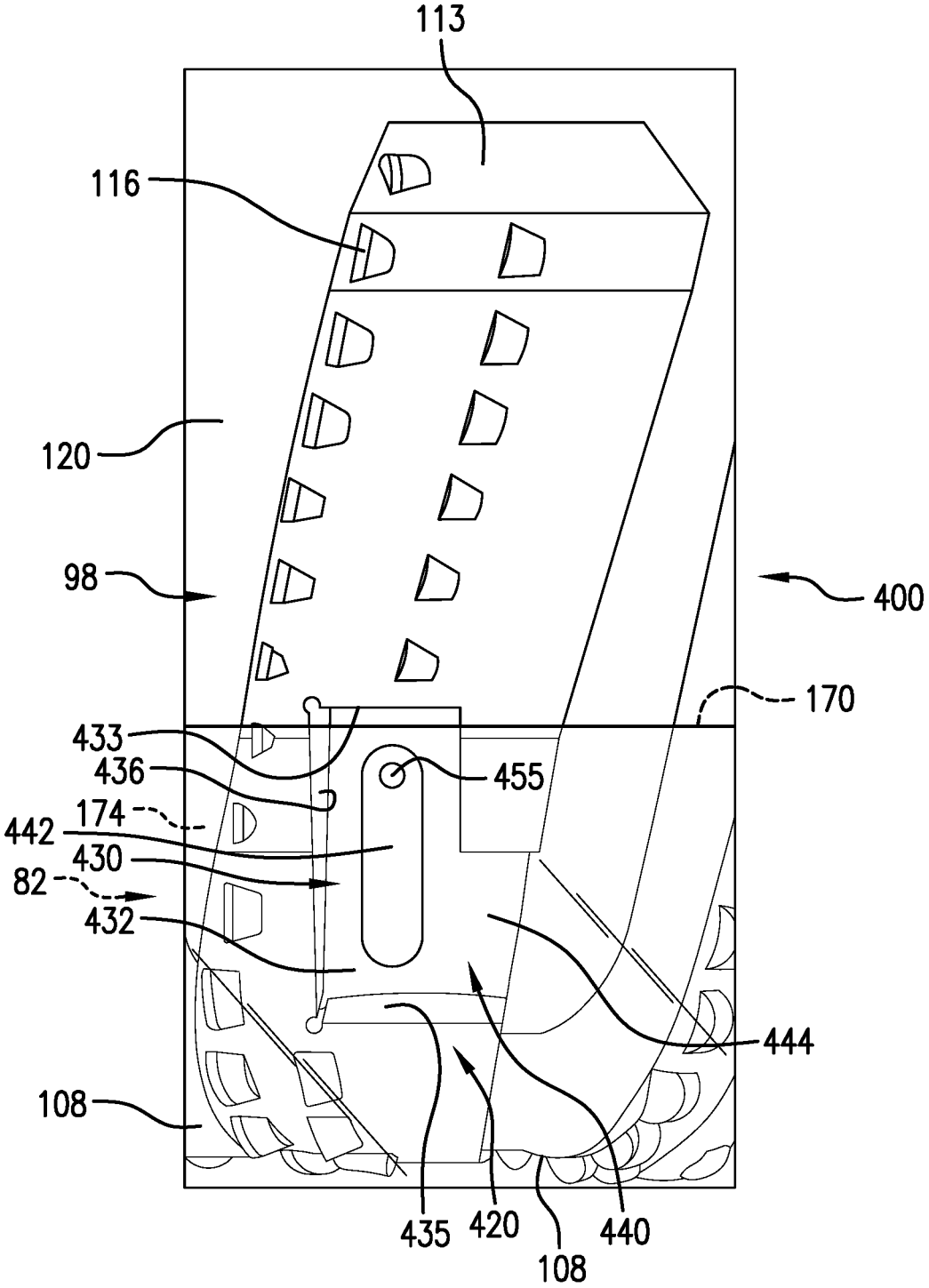
FIG. 12A depicts release system for a window mill and whipstock connector showing the window mill pushing on the whipstock connector in a torque transmitting position, in accordance with still yet another aspect of an exemplary embodiment.
Figure 12B:
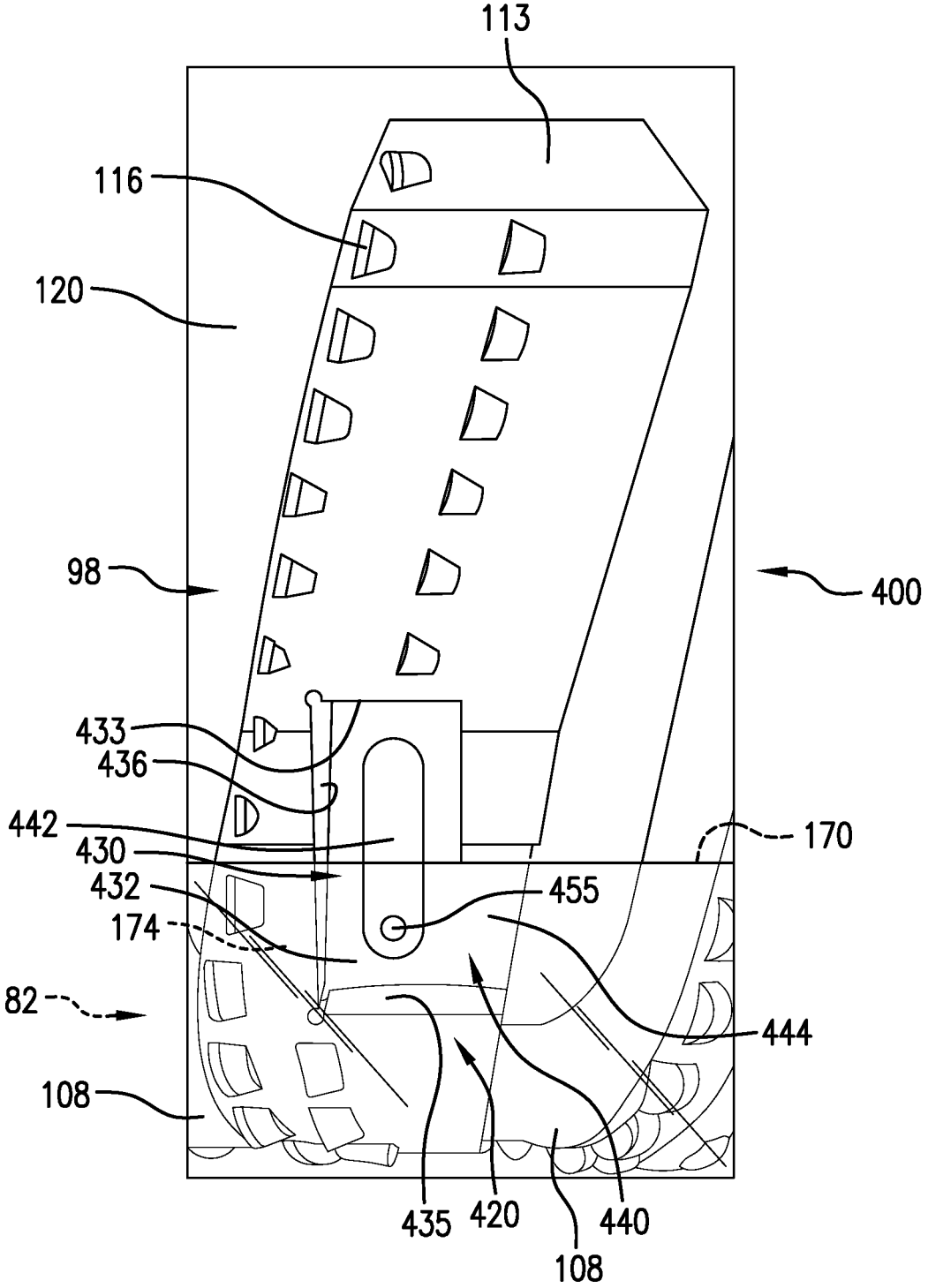
FIG. 12B depicts release system for a window mill and whipstock connector of FIG. 12A in a pre-release position.

Reference will now follow to FIGS. 12A-12B, wherein like reference numbers represent corresponding parts in the respective views, in describing a window mill 400 in accordance with yet another exemplary embodiment. Window mill 400 includes a plurality of lug pockets, one of which is indicated at 420 that provide an interface with Whipstock connector 82 as will be detailed herein. Each lug pocket 420 is formed in a corresponding one of the plurality of blades 112, 113 and others.

In the exemplary embodiment shown, each lug pocket 420 is generally L-shaped and includes a longitudinally extending leg 430 including base wall 432, an upper wall 433, a lower wall 435, and a side wall 436. A branch leg 440 extends substantially perpendicularly outwardly of longitudinally extending leg 430. Longitudinally extending leg 430 includes a base wall 436 that extends between upper wall 433 and lower wall 435. Base wall 436 extends into window mill 400 a first depth and includes a longitudinally extending slot 442.

In further accordance with an exemplary aspect, branch leg 440 includes an angled base wall 444 that extends from the first depth of base wall 436 radially outwardly toward a surface (not separately labeled) of window mill 400. As will be detailed herein, angled base wall 444 defines a ramp that allows, for example, lug 180 to transition out of lug pocket 420.

Window mill 400 is coupled to whipstock connector 82 such that each lug 180 enters branch leg 440. Whipstock connector 82 and/or window mill 400 is rotated such that each lug 180 settles between upper wall 433 and lower wall 435. A frangible fastener 455 is threshed into threaded passage 182. Fastener 455 passes through lug 180 and extends into slot 442. With this arrangement, lug 180 is constrained in lug pocket 420 and may travel between upper wall 433 and lower wall 435.

When ready to be installed into wellbore 34, third tubular segment 62*c* may be hoisted and lowered into position and held at a rotary table (not shown). Second tubular segment 62*b* may be brought into position and connected with third tubular segment 62*c*. First tubular segment 62*a* may then be connected with second tubular segment 62*b* and tubular string 30 run into wellbore 34 to a selected depth at which point anchor 88 may be set.

During run in, it may be desirable to axially load tubular string 30 in compression and/or tension. In compression, lug 180 may travel toward and engage upper wall 433 as shown in FIG. 12B. In tension, lug 180 may travel toward and engage lower wall 435. With this arrangement, the window mill 400/whipstock connector 82 can withstand high loading in both tension and compression. Further, window mill 400 may be rotated such that lug 180 engages side surfaces (not of lug pocket 320 at upper wall 433. Side surface of longitudinal slot 442 at upper wall 433 enables window mill and whipstock 84 to withstand high rotary loads under both clockwise and counter-clockwise rotation. Thus, tubular string may be manipulated to clean internal surfaces of casing 40 with scraper or brush 90.

After setting anchor 88 it may be desired to separate window mill 400 and whipstock connector 82. At such a time, lug 180 is positioned adjacent to lower wall 435 such as by lifting up on tubular string 30. A rotary force is applied to window mill 400 causing frangible fastener 455 to fail, e.g., break shear etc. Lug 180 may then transition up angled base wall 444 and pass out of lug pocket 420. Tubular string 30 may then be lifted to separate window mill 300 from whipstock connector 82.

Figure 13:
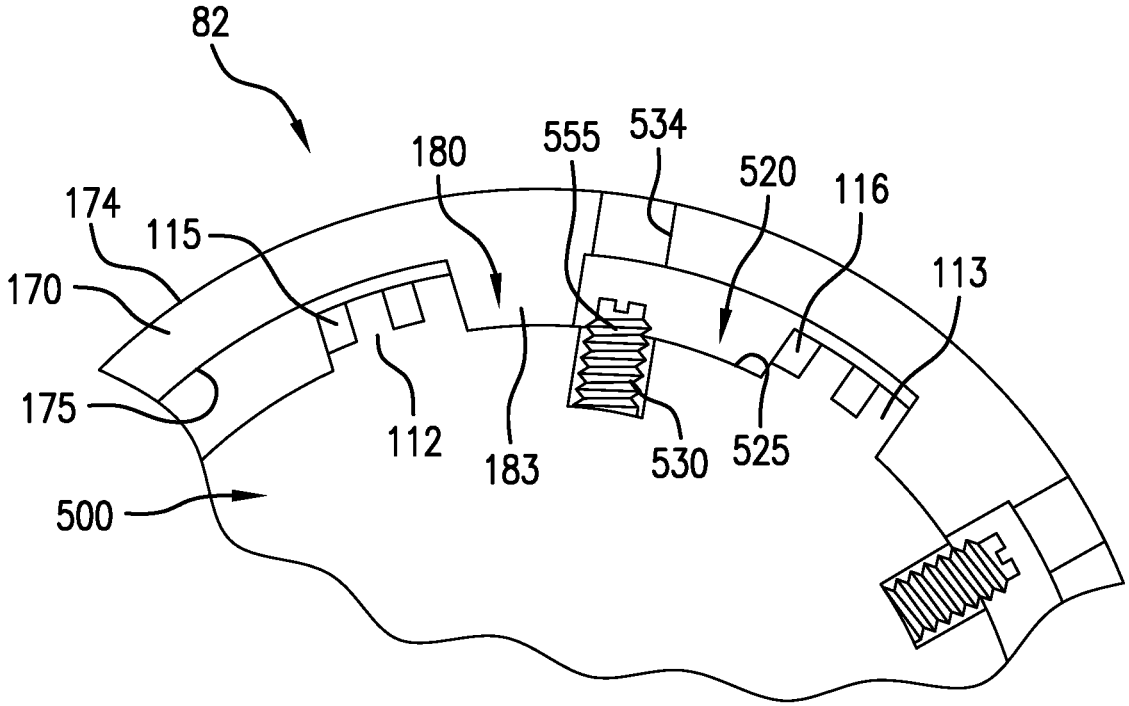
FIG. 13 depicts release system for a window mill and whipstock connector in, in accordance with yet still another aspect of an exemplary embodiment.

Reference will now follow to FIG. 13, wherein like reference numbers represent corresponding parts in the respective views, in describing a window mill 500 in accordance with still yet another aspect of an exemplary embodiment. Window mill 80 includes an elongated lug pocket 520 having a base wall 525. A threaded opening 530 may be provided in base wall 525. Whipstock connector 82 may include un-threaded openings 534 spaced radially from each lug 180.

With this arrangement, each lug 180 is positioned into a corresponding elongated lug pocket 520. Window mill 500 and or whipstock connector 82 may be rotated and a frangible fastener 555 installed through un-threaded opening 534 into threaded opening 530. Frangible fastener 555 allows lug 180 to travel longitudinally in elongated lug pocket 520. In a manner similar to that described above, elongated lug slot 520 may support compression and tensile loading as well as torsional loading in one direction. Torsional loading in an opposing direction will force lugs 180 against corresponding ones of frangible fasteners 555. Additional torsional loading will cause frangible fasteners to fail allowing window mill 500 to separate from whipstock connector 82 in a manner similar to that described herein.

Figure 14:
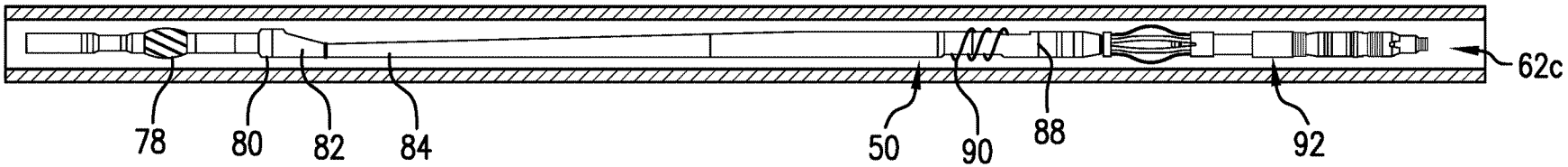
FIG. 14 depicts window cutting system being positioned to clean internal surfaces of a casing tubular and set a bridge plug, in accordance with an aspect of an exemplary embodiment.

As discussed herein, the connection between, for example, window mill 80 and whipstock 84 in accordance with exemplary embodiments allow string 30 to be rotated at 40 RPM or above during run-in. Further, the high push-pull capability provided by the connection provided by whipstock connector 82 allows for the use various tools arranged downhole of whipstock connector 82. In accordance with a non-limiting example shown in FIG. 14, tubular string 30 is run into well bore 34 to a selected depth. At the selected depth, scraper 90 may be deployed and tubular string 30 may be manipulated, e.g., rotated and moved with a push-pull forces to clean annular wall 38 of casing 40.

Figure 15:
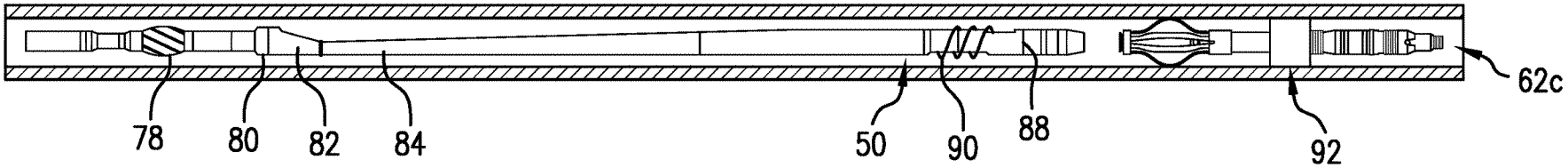
FIG. 15 depicts the bridge plug after setting and the window cutting system being positioned to map a location for, and cut a window in, the casing tubular.

After annular wall 38 has been prepared, casing tubular 30 may be manipulated to position bridge plug 92 at a selected location. Casing tubular may be rotated, pushed, and/or pulled to set bridge plug 92 against annular wall 38. Once bridge plug 92 is set, an overpull three may be applied to tubular string 30 to disconnect from a lower portion of third segment 62*c* as shown in FIG. 15. At this point, tubular string 30 may be moved upwardly to a selected position and rotated to map casing tubular 40 with CICM 68 to determine where to form a casing window. Whipstock 84 may be secured to casing tubular 40, window mill 80 may be disconnected from whipstock connector 82 and a casing window may be formed.

At this point, it should be understood that in accordance with the non-limiting examples described herein, the window mill to whipstock coupling provided by the whipstock connector allows both rotational and axial, e.g., push/pull forces to be applied to the tubular string. The whipstock connector isolates the shear components from stresses that may be associated with activating and manipulating various tools in the wellbore. Thus, the likelihood that the whipstock will unexpectedly detach from the window mill and fall to a toe of the wellbore is eliminated. Further, the window mill to whipstock coupling provided by the whipstock connector allows operators to prepare a casing tubular, map a location of a casing window, and then form the casing window in a single trip. Set forth below are some embodiments of the foregoing disclosure:

Embodiment 1. A method of performing a well bore operation in a well bore, the method comprising: connecting a window mill to a whipstock connector forming a tubular section; supporting a tool below the whipstock connector; running the window mill, the whipstock connector, and the tool into the well bore; and axially loading the tool to perform the well bore operation.

Embodiment 2. The method according to any prior embodiment, wherein supporting the tool includes mounting one of a brush and a scraper downhole of the whipstock connector.

Embodiment 3. The method according to any prior embodiment, wherein axially loading the tool includes applying at least one of a push force and a pull force on the one of the brush and the scraper without disconnecting the window mill and the whipstock connector.

Embodiment 4. The method according to any prior embodiment, wherein supporting the tool includes connecting a bridge plug below the whipstock connector.

Embodiment 5. The method according to any prior embodiment, wherein axially loading the tool includes one of pulling up on the window mill, and pushing down on the window mill, and rotating the window mill to set the bridge plug.

Embodiment 6. The method according to any prior embodiment, further comprising: disconnecting the window mill and the whipstock connector from the bridge plug.

Embodiment 7. The method according to any prior embodiment, further comprising: repositioning the window mill and the whipstock connector in the well bore; and anchoring the whipstock connector to a casing tubular extending into the well bore.

Embodiment 8. The method according to any prior embodiment, further comprising: cutting a window in a tubular after the bridge plug is set without extracting the window mill from the well bore.

Embodiment 9. The method according to any prior embodiment, further comprising: disconnecting the window mill from the whipstock connector after axially loading the tool.

Embodiment 10. The method according to any prior embodiment, wherein disconnecting the window mill includes rotating the window mill to break a shear pin.

Embodiment 11. The method according to any prior embodiment, wherein disconnecting the window mill includes rotating the window mill to disengage from a lug provided on the whipstock connector.

Embodiment 12. The method according to any prior embodiment, wherein axially loading the window mill includes transferring one of a pull and a push force from the window mill to the whipstock connector.

Embodiment 13. The method according to any prior embodiment, further comprising: activating a casing integrity/casing mapping (CICM) system mounted to uphole of the window mill and the whipstock connector to scan a casing tubular.

Embodiment 14. The method according to any prior embodiment, wherein activating the CICM includes rotating the window mill and the whipstock connector.

Embodiment 15. The method according to any prior embodiment, further comprising: cutting a window in a tubular after identifying a casing collar location with the CICM without extracting the window mill from the well bore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of performing a well bore operation in a well bore, the method comprising:

connecting a window mill to a whipstock connector forming a tubular section;

supporting a tool below the whipstock connector;

running the window mill, the whipstock connector, and the tool into the well bore;

axially loading the tool to perform the well bore operation;

setting an anchor connected to the whipstock connector after performing the well bore operation; and disconnecting the window mill from the whipstock connector after setting the anchor.

2. The method of claim 1, wherein supporting the tool includes mounting one of a brush and a scraper downhole of the whipstock connector.

3. The method of claim 2, wherein axially loading the tool includes applying at least one of a push force and a pull force on the one of the brush and the scraper without disconnecting the window mill and the whipstock connector.

4. The method of claim 1, wherein supporting the tool includes connecting a bridge plug below the whipstock connector.

5. The method of claim 4, wherein axially loading the tool includes one of pulling up on the window mill, and pushing down on the window mill, and rotating the window mill to set the bridge plug.

6. The method of claim 5, further comprising: disconnecting the window mill and the whipstock connector from the bridge plug.

7. The method of claim 6, further comprising:

repositioning the window mill and the whipstock connector in the well bore after performing the wellbore operation; and anchoring the whipstock connector to a casing tubular extending into the well bore after repositioning the window mill and the whipstock connector.

8. The method of claim 7, further comprising: cutting a window in a tubular after the bridge plug is set without extracting the window mill from the well bore.

9. The method of claim 1, further comprising: disconnecting the window mill from the whipstock connector after axially loading the tool.

10. The method of claim 9, wherein disconnecting the window mill includes rotating the window mill to break a shear pin.

11. The method of claim 10, wherein disconnecting the window mill includes rotating the window mill to disengage from a lug provided on the whipstock connector.

12. The method of claim 1, wherein axially loading the window mill includes transferring one of a pull and a push force from the window mill to the whipstock connector.

13. The method of claim 1, further comprising: activating a casing integrity/casing mapping (CICM) system mounted to uphole of the window mill and the whipstock connector to scan a casing tubular.

14. The method of claim 13, wherein activating the CICM includes rotating the window mill and the whipstock connector.

15. The method of claim 13, further comprising: cutting a window in a tubular after identifying a casing collar location with the CICM without extracting the window mill from the well bore.

* * * * *